US009352393B2

(12) United States Patent
Ono et al.

(10) Patent No.: US 9,352,393 B2
(45) Date of Patent: May 31, 2016

(54) IRON-BASED POWDER FOR POWDER METALLURGY

(71) Applicant: JFE STEEL CORPORATION, Tokyo (JP)

(72) Inventors: Tomoshige Ono, Yotsukaido (JP); Yukiko Ozaki, Chiba (JP); Takashi Kawano, Chiba (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 14/650,092

(22) PCT Filed: Dec. 24, 2013

(86) PCT No.: PCT/JP2013/007553

§ 371 (c)(1),
(2) Date: Jun. 5, 2015

(87) PCT Pub. No.: WO2014/103287

PCT Pub. Date: Jul. 3, 2014

(65) Prior Publication Data

US 2015/0314372 A1 Nov. 5, 2015

(30) Foreign Application Priority Data

Dec. 28, 2012 (JP) ..... 2012-288682

(51) Int. Cl.
*B22F 1/00* (2006.01)
*B22F 1/02* (2006.01)
*C22C 33/02* (2006.01)

(52) U.S. Cl.
CPC ..... *B22F 1/0011* (2013.01); *B22F 1/0059* (2013.01); *B22F 1/02* (2013.01); *B22F 1/025* (2013.01); *C22C 33/0207* (2013.01); *B22F 1/0062* (2013.01); *Y10T 428/2991* (2015.01)

(58) Field of Classification Search
CPC ..... B22F 1/0011; B22F 1/02; B22F 1/0059; B22F 1/0062; B22F 1/025; C22C 33/0207; Y10T 428/2991
USPC ..... 428/402, 403
See application file for complete search history.

(56) References Cited

U.S. PATENT DOCUMENTS

| | | | | |
|---|---|---|---|---|
| 7,867,314 | B2 | 1/2011 | Ono et al. | |
| 2006/0000310 | A1 * | 1/2006 | Solimnjad | C22C 33/0228 75/252 |
| 2006/0065072 | A1 | 3/2006 | Ozaki et al. | |
| 2009/0007725 | A1 | 1/2009 | Fujiura et al. | |
| 2009/0107292 | A1 | 4/2009 | Ahlin et al. | |
| 2010/0224025 | A1 * | 9/2010 | Ono | C22C 33/0228 75/252 |
| 2012/0219450 | A1 | 8/2012 | Larsson | |

FOREIGN PATENT DOCUMENTS

| | | | |
|---|---|---|---|
| CA | 2307109 | A1 | 4/1999 |
| CA | 2572131 | A1 | 1/2006 |
| CA | 2699033 | * | 3/2009 |
| CA | 2699033 | A | 3/2009 |
| CA | 2893945 | A1 | 7/2014 |
| CN | 1301281 | A | 6/2001 |
| CN | 1768985 | A | 5/2006 |
| CN | 101801566 | A | 8/2010 |
| CN | 101890496 | A | 11/2010 |
| CN | 102652998 | A | 9/2012 |
| CN | 102666895 | A | 9/2012 |
| JP | H01-219101 | A | 9/1989 |
| JP | H02-217403 | A | 8/1990 |
| JP | H03-162502 | A | 7/1991 |
| JP | H05-148505 | A | 6/1993 |
| JP | 2002-515542 | A | 5/2002 |
| JP | 2004-156063 | * | 6/2004 |
| JP | 2004-156063 | A | 6/2004 |
| JP | 2005-187908 | * | 7/2004 |
| JP | 2005-187908 | A | 7/2005 |
| JP | 2007-277712 | A | 10/2007 |
| JP | 2008-505249 | * | 2/2008 |
| JP | 2008-505249 | A | 2/2008 |
| JP | 2009-522446 | A | 6/2009 |
| JP | 4379535 | B1 | 12/2009 |
| JP | 2010053440 | A | 3/2010 |
| JP | 2013-194255 | A | 9/2013 |
| JP | 5673893 | B2 | 2/2015 |
| KR | 20080085907 | A | 9/2008 |
| WO | 99/59753 | A1 | 11/1999 |
| WO | 2006/004530 | A1 | 1/2006 |
| WO | 2009/035119 | A1 | 3/2009 |
| WO | WO2009/035119 | * | 3/2009 |
| WO | 2014/103287 | A1 | 7/2014 |

OTHER PUBLICATIONS

Aug. 5, 2015 Office Action issued in Canadian Patent Application No. 2,893,945.
Sep. 10, 2015 Office Action issued in Korean Patent Application No. 10-2015-7019775.
Apr. 8, 2014 International Search Report issued in International Application No. PCT/JP2013/007553.
Sep. 2, 2014 Office Action issued in Japanese Application No. 2014-525246.
Dec. 24, 2015 Office Action issued in Korean Patent Application No. 10-2015-7019775.
Jan. 6, 2016 Office Action issued in Chinese Patent Application No. 201380068276.7.

* cited by examiner

*Primary Examiner* — Leszek Kiliman
(74) *Attorney, Agent, or Firm* — Oliff PLC

(57) ABSTRACT

An iron-based powder for powder metallurgy effectively prevents agglomeration of a lubricant, has excellent flowability, can evenly fill thin-walled cavities, keeps the ejection force after formation low, and does not lower sintered body strength by adhering either or both of an alloy component and a cutting ability improving agent to the surface of iron powder with a binder that has a melting point of 150° C. or lower, adhering carbon black to the surface of the binder, and setting the amount of free binder to 0.02 mass % or less.

20 Claims, 1 Drawing Sheet

IRON-BASED POWDER FOR POWDER METALLURGY

TECHNICAL FIELD

The present invention relates to an iron-based powder that is suitable for use in powder metallurgy and that has an excellent ability to prevent segregation.

BACKGROUND ART

Powder metallurgical techniques allow for production of machine parts having complicated shapes with extremely high dimensional accuracy and are thus capable of significantly decreasing the production costs of such machine parts. Therefore, various machine parts produced by applying powder metallurgical techniques are used in many fields. Furthermore, in recent years, demand for miniaturization or reduced weight of machine parts has increased, and various precursor powders for powder metallurgy to produce small and lightweight machine parts having sufficient strength have been examined.

JP H01-219101 A (PTL 1), JP H02-217403 A (PTL 2), and JP H03-162502 A (PTL 3), for example, disclose precursor powders for powder metallurgy produced by adhering an alloying powder to surfaces of iron powder or alloy steel powder. Such powders mainly composed of iron (iron-based powder) are usually produced by adding an additive powder (for example, copper powder, graphite powder, iron phosphide powder, manganese sulfide powder, or the like) and a lubricant (for example, zinc stearate, aluminum stearate, or the like), and the resultant mixed powder is used in the production of machine parts.

The iron-based powder, additive powder, and lubricant, however, have different characteristics (shape, particle size, and the like), and thus flowability of the mixed powder is not uniform. Hence, the following problems (a) to (c) occur.

(a) The iron-based powder, additive powder, and lubricant unevenly distribute locally due to the influence of vibration or dropping during transport of the mixed powder to a storage hopper.

(b) Since relatively large spaces occur between particles of the mixed powder charged in the hopper, the apparent density of the mixed powder decreases.

(c) The apparent density of the mixed powder depositing in a lower portion of the hopper increases over time (i.e. under the influence of gravity), whereas the mixed powder stored in an upper portion of the hopper has a low apparent density. Therefore, the apparent density of the mixed powder is not uniform across the upper and lower portions of the hopper.

In other words, with conventional techniques, it is extremely difficult to mass-produce machine parts having uniform strength using mixed powder.

In order to solve the above problems (a) to (c), it is necessary to increase flowability of the mixed powder that includes the iron-based powder, additive powder, and lubricant.

To that end, JP H05-148505 A (PTL 4) discloses an iron-based powder mainly composed of an iron powder having a predetermined range of particle sizes. However, this technique not only decreases the yield of the iron powder, since an iron powder outside of the specified range cannot be used, but also causes difficulty in uniformly and sufficiently filling thin-walled cavities, such as a gear edge or the like, with the iron-based powder.

JP 2002-515542 A (PTL 5) discloses a technique for improving flowability at the time of warm formation by including 0.005% to 2% by weight of $SiO_2$ having a particle size of less than 40 nm. This technique is problematic, however, in that $SiO_2$ remains upon sintering and inhibits sintering between iron powder particles, thereby decreasing the strength of the resultant sintered body.

To address these problems, JP 2008-505249 A (PTL 6) discloses a method for increasing the flowability of a composition for powder metallurgy that includes an iron or iron-based metal powder, a lubricant, and/or a binder. With this method, 0.001% to 0.2% by weight of carbon black having a particle size of less than 200 nm and a specific surface area larger than 100 $m^2/g$ is added to the composition.

JP 2009-522446 A (PTL 7) discloses a composition for iron-based powder metallurgy that includes an iron powder or iron-based metal powder and a particulate composite lubricant, wherein the composite lubricant includes particles having a core that includes solid organic lubricating material, fine carbon particles being adhered to the organic lubricating material. This is a technique to mix iron powder with a lubricant having fine carbon particles on the surface thereof in advance before mixing the iron powder and the composite lubricant so as to achieve excellent flowability and to prevent agglomeration between the lubricants.

For the same purpose, JP 4379535 B2 (PTL 8) discloses an iron-based powder for powder metallurgy in which flowability improving particles that include 50 mass % to 100 mass % of carbon black are adhered to the surface of iron powder with a binder, the degree of penetration of the binder being in a range of 0.05 mm to 2 mm, the coverage of the iron powder by the binder being 10% or more and 50% or less and the coverage of the binder by the flowability improving particles being 50% or more.

CITATION LIST

Patent Literature

PTL 1: JP H01-219101 A
PTL 2: JP H02-217403 A
PTL 3: JP H03-162502 A
PTL 4: JP H05-148505 A
PTL 5: JP 2002-515542 A
PTL 6: JP 2008-505249 A
PTL 7: JP 2009-522446 A
PTL 8: JP 4379535 B2
PTL 9: JP 2007-277712 A

SUMMARY OF INVENTION

Technical Problem

With the technique disclosed in PTL 6, it is essential that the specific surface area of carbon black be made larger than 100 $m^2/g$. In this case, however, the apparent density of the mixed powder decreases, causing compressibility to lower, which is not desirable. Other problems include how powder with a large specific surface area generally has a small apparent density, making handing difficult, and how mixing is difficult and takes more time due to the large difference in specific gravity from the iron powder.

The technique disclosed in PTL 7 requires a step for adhering the fine carbon particles to the lubricant surface in advance and therefore is inefficient. At the same time, since there is a difference in density with the iron powder, the problem of segregation of the powder ends up not being resolved.

Furthermore, in the technique disclosed in PTL 8, a powder with typical lubricity is used as the binder, yet if the coverage of the iron powder surface by the binder is 50% or less, the lubricity of the iron powder itself is insufficient, and forming such iron powder leads to problems such as the iron powder burning onto the die, an increase in the ejection force, and in some cases an irregular appearance of the green compact or damage thereto.

To compensate for such insufficient lubrication, documents such as PTL 8 propose using not only a lubricant as a binder, but also including approximately 0.1% to 1.0% of a lubricant that does not bind to the iron powder, i.e. a so-called free lubricant. Typically, these lubricants are newly added and mixed after treatment with a binder to prevent segregation.

At this time, however, if the mixing temperature is too high, the lubricants may agglomerate, yielding abnormal agglomerated particles. Forming with powder into which such agglomerated particles are mixed not only yields an irregular appearance on the surface of the green compact, but also due to dewaxing at the time of sintering, the lubricant at this portion may separate, yielding cavities. When present on the surface of the sintered body, such cavities yield a poor appearance and may also lead to a reduction in strength.

As an iron powder mixture including carbon black, a technique such as the one in JP 2007-277712 A (PTL 9) has also been disclosed to improve the sintered body characteristics of the carbon source for carburizing. With this technique, a large amount of carbon black having a relatively small specific surface area of 50 $m^2/g$ or less is used. Since carbon black is a fine particle, it acts as a flowability improving agent when added in a small amount, yet upon mixing a large amount into the iron powder, flowability instead worsens, and handling becomes difficult.

When handling carbon black, as described above it is important to understand the characteristics of carbon black well and to be careful with the amount used and the method for use.

The present invention has been developed in light of the above circumstances and provides an iron-based powder for powder metallurgy that has excellent flowability by effectively preventing agglomeration of the lubricant, that can evenly fill even thin-walled cavities, that can keep the ejection force after formation low, that does not yield a poor appearance for the green compact or the sintered body, and that does not lower the sintered body strength.

Note that the iron powder or alloy steel powder serving as the material for the iron-based powder may be atomized iron powder, reduced iron powder, or the like in accordance with the method of production. Within these categories, the term "iron powder" has a broad meaning, encompassing alloy steel powder.

Solution to Problem

In general, during treatment to prevent segregation for powder metallurgy, when alloy components such as iron powder and the additives graphite, copper, and Ni powder are mixed with other components such as a cutting ability improving agent, e.g. MnS, $CaF_2$, or talc, a binder is mixed in, and the binder adheres the additives to the iron powder surface. At this time, resin such as cellulose ester resin, or a lubricative material are selected as the binder. The objectives for doing so are to reduce friction between particles and to improve the flowability, the apparent density, and the compressibility at the time of formation, as well as to reduce friction on the die surface at the time of formation and to improve compressibility and ease of ejection. With regards to the latter objective, however, it suffices for the iron powder at the portion in contact with the die to have lubricity. Even if every individual iron powder particle is provided with lubricity, most of these particles do not contribute to ease of ejection.

Therefore, one method for increasing lubricity at the die surface efficiently is to add a lubricant apart from the binder. The lubricant added with this method is referred to as a free lubricant. Free lubricants are typically wax or metal soap powder. Due to the difference in specific gravity from iron powder, even when free lubricants are mixed with iron powder, they are easily expelled from the mixture to adhere to the die surface when filling the die.

In this way, conventional iron powder treated to prevent segregation includes a lubricant used as a binder and a separate, free lubricant powder that is added and mixed in to approximately 0.4 mass % to 1.5 mass % of the total. In typical use, the binder accounts for approximately 0.1 mass % to 0.6 mass %, and the free lubricant accounts for approximately 0.2 mass % to 1 mass %. The free lubricant that is used has a relatively small average particle size of 5 μm to 40 μm and a relatively low melting point. Particles thus agglomerate easily, often yielding agglomerated particles upon mixing. Such agglomerated particles mar the appearance of the green compact or the sintered body.

To address this problem, the inventors of the present invention intensively studied measures for reducing the free lubricant. As a result, the inventors conceived of a measure for effectively reducing the free lubricant, thus completing the present invention.

Primary features of the present invention are as follows.

1. Iron-based powder for powder metallurgy, wherein either or both of an alloy component and a cutting ability improving agent are adhered to a surface of an iron powder for powder metallurgy by a binder with a melting point of 150° C. or lower, carbon black is adhered to a surface of the binder, and an amount of free binder is 0.02 mass % or less.

2. The iron-based powder for powder metallurgy of 1., wherein coverage of the surface of the iron powder by the binder is from 30% to 100% of a surface area of the iron powder.

3. The iron-based powder for powder metallurgy of 1. or 2., wherein the binder is one or a mixture selected from the group consisting of fatty acid, fatty acid amide, fatty acid bisamide, and metal soap.

4. The iron-based powder for powder metallurgy of any one of 1. to 3., wherein coverage of a bonding surface of the binder by the carbon black is 30% or more of a bonding surface area of the binder.

5. The iron-based powder for powder metallurgy of any one of 1. to 4., wherein a specific surface area of the carbon black is in a range of 50 $m^2/g$ to 100 $m^2/g$.

6. The iron-based powder for powder metallurgy of any one of 1. to 5., wherein a specific surface area of the iron powder is in a range of 0.01 $m^2/g$ to 0.1 $m^2/g$.

7. The iron-based powder for powder metallurgy of any one of 1. to 6., wherein a specific surface area of the iron-based powder for powder metallurgy is in a range of 0.05 $m^2/g$ to 0.5 $m^2/g$.

Advantageous Effect of Invention

The present invention provides an iron-based powder for powder metallurgy that evenly fills thin-walled cavities and keeps the ejection force after formation low, that does not yield a poor appearance for the green compact or the sintered body, and that does not lower the sintered body strength.

BRIEF DESCRIPTION OF DRAWINGS

The present invention will be further described below with reference to the accompanying drawings, wherein.

DESCRIPTION OF EMBODIMENTS

The present invention will be described in detail below.

Figure 1:
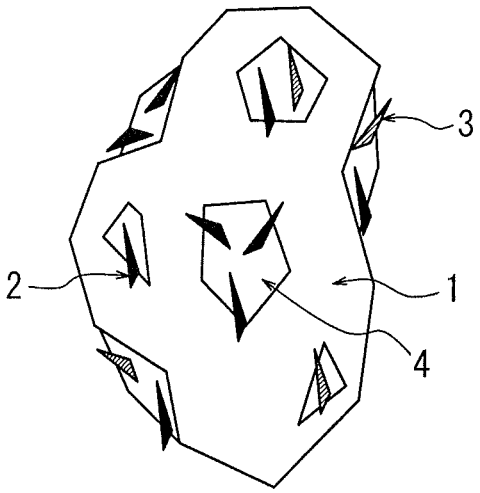
FIG. 1 is a schematic view of the iron-based powder for powder metallurgy of the present invention.

In the present invention, a high-speed mixer, which is a type of mechanical stirring-type mixer, is used to heat and mix iron powder, alloy components such as graphite, Cu powder, and Ni powder, and cutting ability improving agents such as MnS powder, $CaF_2$ powder, talc, and the like, along with a binder. Furthermore, in the process of manufacturing an iron-based powder for powder metallurgy by adding a lubricant to guarantee formability, when adding and mixing the binder and the lubricant, a binder and carbon black are added and mixed instead of adding the binder and lubricant. In other words, either or both of an alloy component and a cutting ability improving agent are adhered to the surface of the iron powder for powder metallurgy according to the present invention by a binder, and carbon black is adhered to the surface of the binder. FIG. 1 schematically illustrates the iron-based powder used in the present invention. In FIG. 1, reference sign 1 indicates iron powder, 2 indicates an alloy component (graphite), 3 indicates an alloy component (copper powder), and 4 indicates the binder.

Accordingly, in the present invention, carbon black (not illustrated) is adhered to the surface of the binder 4 in FIG. 1.

The melting point of the binder is 150° C. or lower. These components are the same as a portion of conventional binders or lubricants, yet in the present invention, by limiting the melting point and performing the step to add and mix the carbon black described below, the free binder is reduced, a feature not included in conventional techniques.

Furthermore, by heating and mixing, the binder is melted once, evenly moistening the individual iron powder particles, alloy components, and the like. The binder is subsequently cooled and hardened so as to fix to the surface of the iron powder. A heating and mixing temperature exceeding 150° C. is too high, and subsequent cooling takes time, which not only is inefficient for the present invention, which includes a step of adding and mixing flowability improving particles, but also makes it easier for the carbon black to penetrate into the binder layer. On the other hand, if the temperature is 150° C. or lower, one cycle of mixing by heating and cooling can be performed in approximately one hour. Accordingly, it is important for the melting point of the binder used here to be 150° C. or lower. The lower limit of the melting point of the binder is not restricted yet is preferably approximately 80° C.

The binder that is used may be a type that melts upon heating or a type that hardens upon heating, yet the binder needs to have lubricity after hardening. The reason is to lower friction between powder particles, improve flowability of the powder, and encourage particle rearrangement at the start of formation. Specifically, the binder is preferably one or a mixture selected from the group consisting of fatty acid, fatty acid amide, fatty acid bisamide, and metal soap. Amide wax, polyamides, polyethylene, polyethylene oxide, and the like may also be used. In particular, zinc stearate, lithium stearate, calcium stearate, stearic acid monoamide, and ethylenebis stearamide are preferable. These binders may be used alone, or a mixture of two or more may be used.

The carbon black used here is used as toner or as paint, and the specific surface area thereof is preferably 50 $m^2/g$ or more and 100 $m^2/g$ or less. The reason is that if the specific surface area is less than 50 $m^2/g$, the particle size increases, and therefore in order to cover the surface of the binder, more carbon black needs to be added, and the compressibility of the mixed powder tends to worsen. Conversely, if the specific surface area exceeds 100 $m^2/g$, the dimensions vary at the time of sintering, and the mechanical properties worsen. Accordingly, the specific surface area of the carbon black is preferably 50 $m^2/g$ or more and 100 $m^2/g$ or less. In the present invention, the method of measuring the specific surface area of the carbon black is preferably in accordance with the BET method (JIS K 6217).

The average particle size of the carbon black is not restricted, yet a range of 5 nm to 500 nm is preferable.

If the average particle size of the carbon black is less than 5 nm, the carbon black might become buried within irregularities on the iron powder surface or within the lubricant present on the iron powder surface. Furthermore, such fine particles exist as agglomerations, yet if the particles are too small, the agglomerations may directly adhere to the iron powder surface, which is not desirable. On the other hand, if the average particle size of the carbon black exceeds 500 nm, the particles already have the same curvature as the irregularities on the iron powder surface, making it meaningless to bother with adhering such particles. For these reasons, the average particle size of the flowability improving particles is preferably in a range of 5 nm to 500 nm.

Note that the average particle size of the carbon black is the arithmetic mean diameter calculated by observing carbon black particles under an electron microscope.

If the amount of carbon black that is added is less than 0.01 parts by mass per 100 parts by mass of iron powder, the coverage of the binder surface may be insufficient, causing the effect of flowability improvement to be almost unnoticeable. Conversely, if the amount added exceeds 3 parts by mass, the free powder increases, and when forming at identical pressure, the density of the green compact decreases, and the strength of the sintered body decreases, which is not desirable. Accordingly, the amount of carbon black added is preferably in a range of 0.01 to 3 parts by mass per 100 parts by mass of iron powder.

It is generally known that if fine irregularities are present on the surface of powder particles, the contact area between the particles is decreased, thereby decreasing adhesive force between the particles. Although the water atomized iron powder and reduced iron powder also have surface irregularities, the irregularities are not sufficient for decreasing adhesive force, since the curvature is a relatively small value of 0.1 $\mu m^{-1}$ to 50 $\mu m^{-1}$.

In other words, an additional effect of adding carbon black is to provide fine irregularities on the iron powder surface, thereby reducing the contact area between the particles and lowering the adhesive force between particles. Another effect is that of preventing adhesion between binder particles on the iron powder surface.

In the present invention, the coverage of the iron powder surface by the binder is from 30% to 100%, preferably from 50% to 100%, of the iron powder surface area.

If the coverage is less than 30%, alloy components and the like cannot be sufficiently adhered to the iron powder surface. When the coverage is less than 50%, the function as a lubricant might not be sufficiently achieved. Therefore, the coverage of the iron powder surface by the binder is 30% or more, preferably 40% or more, and more preferably 50% or more. An upper limit of 100% is acceptable.

When adhering additives such as alloy components to the iron powder surface with the binder, not all of the binder adheres to the iron powder surface even when these additives are heated and mixed in and subsequently cooled and hardened. The free binder generated at this time causes the graphite additive to agglomerate, and free binder particles also agglomerate together. Furthermore, the remaining free binder that does not adhere to the iron powder surface not only negatively influences flowability but may also mar the appearance of the green compact or the sintered body.

In order to remove such free binder, a method such as the following is applied in the present invention. Separate mixers are used for fixing the binder and for adding carbon black. The mixer for heating and mixing is preferably disposed at the upper portion, and the mixer for mixing in carbon black is preferably disposed at the lower portion.

The mixer for fixing the binder can mix while heating and cooling and has a comparatively strong shear force. For example, a mixer such as a Henschel mixer is preferably used. Here, after sufficiently heating and mixing the iron powder, binder, and additives at or above the melting point of the binder, the result is cooled to below the melting point of the binder.

This cooling is performed sufficiently. If carbon black is mixed in while in a state of insufficient cooling, the binder does not sufficiently harden on the iron powder surface, resulting in the carbon black penetrating into the binder layer, which weakens the effect of covering the surface of the binder. Furthermore, the melted binder and carbon black might form agglomerated particles. In the present invention, free lubricant is not added during the above steps, offering the advantage of not generating agglomerated particles from free lubricant.

Subsequently, the carbon black is charged into the mixer for adding carbon black. At this time, powder falls from the upper portion to the lower portion, producing dust. This dust is mainly composed of light components in the mixture and includes binder, fine particles of iron powder, and the like. Collecting this dust is preferable, as doing so allows for removal of remaining binder.

The above mixing procedure is now described in greater detail.

The above predetermined amount of iron powder is charged into the high-speed mixer that is the first mixer, and the alloy components of graphite, Cu powder, and the like are added along with the binder. After injecting these raw materials, heating and mixing begin. The rotational speed of the rotor blade in the high-speed mixer depends on the size of the mixing tank and the shape of the rotor blade yet is generally about 1 m/s to 10 m/s in terms of the peripheral speed at the tip of the rotor blade. Heating and mixing are performed until the temperature in the mixing tank reaches at least the melting point of the binder, and mixing is performed at a temperature of the melting point or higher for approximately 1 to 30 minutes. After the raw materials are sufficiently mixed, the mixing tank is cooled. When the binder solidifies in the cooling step, additives such as alloy components adhere to the surface of the iron powder.

As described above, sufficient cooling is necessary in the cooling step for binder to solidify, so that subsequently the carbon black does not penetrate into the binder and so that the binder and the carbon black do not form agglomerated particles. Before adding the carbon black, cooling is preferably performed to a temperature that is at least 30° C. lower, more preferably at least 50° C. lower, than the melting point of the binder. When using a plurality of binders, the binder with the lowest melting point is used as a standard when determining the above cooling temperature.

After sufficient cooling, the iron powder is discharged from the first mixer and charged into the second mixer. At this time, a dust collection port is provided near the discharge port, and a light component including the free binder is collected along with fine powder. A sieve with an opening of approximately 60 mesh may be placed directly below the discharge port in order to collect dust occurring there. With these processes, it is important in the present invention to reduce the free binder in the iron-based mixed powder insofar as possible, and it is crucial that the mass of the free binder after magnetic separation with respect to the mass of iron-based mixed powder before magnetic separation (free binder mass after magnetic separation/mass of iron-based mixed powder before magnetic separation) be 0.02 mass % or less.

Furthermore, after the binder completely hardens and the free component is removed, carbon black is added. Carbon black with a particle size of approximately 25 nm to 80 nm is added after the binder hardens, yet since this particle size is extremely small, the particles adhere to the iron powder surface due to van der Waals forces and an electrostatic force.

The heating and mixing as well as the mixing of carbon black may be performed with one mixer. In this case as well, the mixture is first discharged after heating and mixing. At this time, a dust collector is placed by the discharge port to remove light components such as the remaining binder. An approximately 60 mesh sieve may be placed by the discharge port and the mixture discharged onto the sieve in order to collect dust occurring there. A method may also be adopted to remove components not adhered to the iron powder by magnetic separation or pneumatic/magnetic separation.

In the present invention, the coverage of the binder by the carbon black, which is adhered to the surface of the binder, is preferably 30% or more of the bonding surface area of the binder.

As described above, the binder fixed to the iron powder surface reduces friction between particles, yet the attraction between particles and the adhesive force increase. Accordingly, in order to achieve iron powder with a truly good flow, the surface of the binder is preferably covered in fine particles or the like, thereby reducing the adhesive force between binder particles.

Carbon black is appropriate for covering the binder, and when the coverage by the carbon black is less than 30% of the bonding surface area of the binder, the effect of reducing the adhesive force is small. Therefore, the coverage is preferably 30% or more. No restriction is placed on the upper limit of the coverage by the carbon black, and the entire bonding surface area of the binder, i.e. 100%, may be covered.

The specific surface area of the iron powder (iron powder for powder metallurgy) used in the present invention is preferably 0.01 $m^2/g$ to 0.1 $m^2/g$. The reason is that if the specific surface area of the iron powder is less than 0.01 $m^2/g$, the strength of the green compact and the sintered body decreases, whereas if the specific surface area of the iron powder exceeds 0.1 $m^2/g$, the amount of binder required to cover the surface of the iron powder needs to be increased. In the present invention, the method of measuring the specific surface area of the iron powder is preferably in accordance with the BET method.

The iron-based powder for powder metallurgy in the present invention is produced as follows. Alloy components such as graphite and copper powder, and/or cutting ability improving agents such as MnS, $CaF_2$, enstatite, and steatite are adhered to iron powder with a binder. Subsequently, carbon black is adhered to the surface of the binder. As described above, if the added amount of carbon black is too small, the surface of the binder cannot be covered, whereas if the added amount is too large, fine particles exist in a free state, which reduces the apparent density and reduces flowability. Therefore, there is an appropriate range for the added amount of carbon black. Furthermore, if the mixing method is not appropriate, carbon black cannot be adhered to the surface of the binder.

The specific surface area of the iron-based powder for powder metallurgy is an important factor in determining the appropriate conditions for adhesion and the amount of free carbon black. In other words, when carbon black does not sufficiently adhere and remains in a free state, the specific surface area of the mixed powder (iron-based powder for powder metallurgy) increases, whereas if adhesion is sufficient, the specific surface area decreases. If carbon black adheres excessively and penetrates into the binder, the specific surface area of the mixed powder reduces even further.

In this way, by examining the specific surface area of the iron-based powder for powder metallurgy, it is possible to determine the appropriateness of the state of adhesion of carbon black.

The specific surface area of the iron-based powder for powder metallurgy according to the present invention is preferably 0.05 $m^2/g$ to 0.5 $m^2/g$.

The reason is that if the specific surface area is less than 0.05 $m^2/g$, the carbon black for example penetrates into the binder, making it difficult to adhere the necessary amount onto the iron powder (binder) for guaranteeing flowability. Conversely, if the specific surface area exceeds 0.5 $m^2/g$, more carbon black that does not adhere to the iron powder is in a free state and impedes the flow of the iron powder. In the present invention, the method of measuring the specific surface area of the iron-based powder for powder metallurgy is preferably in accordance with the BET method.

EXAMPLES

At the ratios listed in Table 1, the alloy components of Cu powder and graphite powder, and the binders stearamide (octadecanamide), erucamide, zinc stearate, and Ethylene Bis Stearamide (EBS) were added to iron powder, heated and mixed in a Henschel-type high-speed mixer, cooled to 80° C., and then charged into a nauta mixer. At this time, dust was collected at the discharge port of the high-speed mixer. Carbon black was then added under the conditions listed in Table 1 and mixed.

Next, 1 kg of the resulting powder was magnetically separated. The resulting non-magnetic material (tailing) was placed in water, the portion that did not settle was collected and dried, the mass was measured, and the percentage with respect to the original powder mass was considered to be the amount of free binder.

TABLE 1

| | | Composition ratio of alloy components (mass %) | | Binder | | | | Condition of iron powder surface | | |
|---|---|---|---|---|---|---|---|---|---|---|
| Test ID | Iron powder | Copper powder | Graphite | Type | Melting point of binder (° C.) | Amount added (parts by mass) | Heating and mixing temperature (° C.) | Specific surface area ($m^2/g$) | Coverage of iron powder surface by binder (%) | Coverage of binder surface by carbon black (%) |
| Inventive Example 1 | 97.2 | 2 | 0.8 | stearamide<br>EBS | 110<br>145 | 0.3<br>0.3 | 130 | 0.045 | 42 | 55 |
| Inventive Example 2 | 97.2 | 2 | 0.8 | stearamide<br>EBS | 110<br>145 | 0.4<br>0.4 | 130 | 0.045 | 50 | 60 |
| Inventive Example 3 | 97.2 | 2 | 0.8 | erucamide<br>EBS | 80<br>145 | 0.7<br>0.7 | 130 | 0.045 | 90 | 80 |
| Inventive Example 4 | 97.2 | 2 | 0.8 | erucamide<br>EBS | 80<br>145 | 0.4<br>0.4 | 130 | 0.045 | 55 | 60 |
| Inventive Example 5 | 97.2 | 2 | 0.8 | zinc stearate<br>EBS | 130<br>145 | 0.4<br>0.4 | 135 | 0.045 | 48 | 60 |
| Inventive Example 6 | 97.2 | 2 | 0.8 | polyethylene<br>EBS | 130<br>145 | 0.4<br>0.4 | 135 | 0.045 | 48 | 60 |
| Inventive Example 7 | 97.2 | 2 | 0.8 | stearamide<br>EBS | 110<br>145 | 0.4<br>0.4 | 130 | 0.045 | 50 | 60 |
| Inventive Example 8 | 97.2 | 2 | 0.8 | stearamide<br>EBS | 110<br>145 | 0.4<br>0.4 | 130 | 0.045 | 50 | 60 |
| Comparative Example 1 | 97.2 | 2 | 0.8 | stearamide<br>EBS | 110<br>145 | 0.4<br>0.4 | 130 | 0.045 | 50 | 60 |
| Comparative Example 2 | 97.2 | 2 | 0.8 | stearamide<br>EBS | 110<br>145 | 0.4<br>0.4 | 130 | 0.045 | 50 | 60 |
| Comparative Example 3 | 97.2 | 2 | 0.8 | stearamide<br>EBS | 110<br>145 | 0.3<br>0.3 | 130 | 0.045 | 50 | 60 |

| | Secondary additive | | | | | |
|---|---|---|---|---|---|---|
| | Lubricant | | Carbon black | | | |
| Test ID | Type | Amount added (parts by mass) | Specific surface area ($m^2/g$) | Average particle size (nm) | Amount added (parts by mass) | Temperature when added (° C.) |
| Inventive Example 1 | none | 0 | 95 | 25 | 0.05 | 80 |
| Inventive Example 2 | none | 0 | 95 | 25 | 0.1 | 80 |
| Inventive Example 3 | none | 0 | 95 | 25 | 0.2 | 80 |

TABLE 1-continued

| | | | | | | |
|---|---|---|---|---|---|---|
| Inventive Example 4 | none | 0 | 95 | 25 | 0.1 | 60 |
| Inventive Example 5 | none | 0 | 95 | 25 | 0.1 | 60 |
| Inventive Example 6 | none | 0 | 95 | 25 | 0.1 | 60 |
| Inventive Example 7 | none | 0 | 50 | 80 | 0.1 | 80 |
| Inventive Example 8 | none | 0 | 70 | 50 | 0.1 | 80 |
| Comparative Example 1 | none | 0 | 95 | 25 | 0.1 | 80 |
| Comparative Example 2 | none | 0 | 95 | 25 | 0.1 | 100 |
| Comparative Example 3 | ZnSt | 0.2 | 95 | 25 | 0.1 | 60 |

EBS: Ethylene Bis Stearamide

Figure 2:
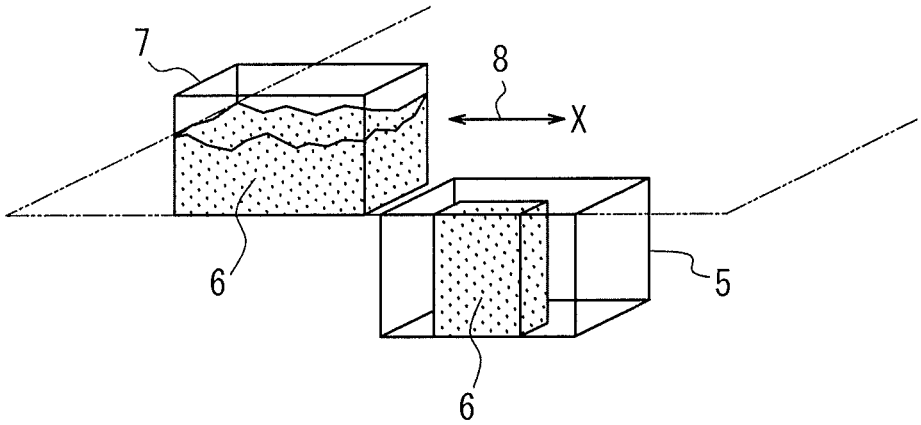
FIG. 2 illustrates a powder filling tester used in the Examples.

The filling performance of each of the iron-based powders obtained in this way was evaluated with the filling tester shown in FIG. 2. Specifically, evaluation was performed by filling iron-based powder 6 into a cavity 5 with a length of 20 mm, a depth of 40 mm, and a width of 5 mm. A filling shoe 7 was moved back and forth in the direction of the arrow 8 in FIG. 2 at a movement rate of 300 mm/s and maintained above the cavity for a holding time of 0.5 s. The filling rate was determined to be the filling density (filling weight/cavity volume) after filling with respect to the apparent density before filling, expressed as a percentage (with a filling rate of 100% representing complete filling). The same test was repeated 10 times, and the filling variation was taken as the (maximum value)−(minimum value) of the filling rate divided by the average for the ten filling rates, expressed as a percentage. Using this mixing powder, a 5 mm thick tensile test piece (conforming to test piece JPMA M 04-1992 2) and a 10 mm thick impact test piece (conforming to JPMA M 05-1992) were formed at a compacting pressure of 686 MPa and then subjected to sintering treatment at 1130° C. for 20 min in an RX atmosphere to produce test pieces. Using these test pieces, the tensile strength and impact value were calculated (conforming to the Japan Powder Metallurgy Association (JPMA), with room temperature as the test temperature). Inventive Examples 1 to 8 in Table 2 indicate the test results.

In terms of appearance, three cylindrical tablets with an outer diameter of 11.3 mm ϕ by a height of 11 mm h were formed, and visual observation was made of whether foreign matter of at least 0.3 mm (black specks) was present on the surface. During this observation, the case of no black specks whatsoever was evaluated as good, and one or more black specks as poor.

TABLE 2

| | Characteristics | | | | | | | | |
|---|---|---|---|---|---|---|---|---|---|
| | | | | Formation characteristics (11.3 mm ϕ × 11 mm h) | | | Sintered body characteristics | | |
| Test ID | Specific surface area ($m^2/g$) | Amount of free binder (%) *1 | Filling variation (%) | Compacting pressure (MPa) | Density ($Mg/m^3$) | Ejection force (MPa) | Appearance | Tensile strength (MPa) | Impact value ($J/cm^2$) |
| Inventive Example 1 | 0.08 | 0.01 | 0.2 | 686 | 7.15 | 18 | good | 450 | 15.0 |
| Inventive Example 2 | 0.10 | 0.01 | 0.3 | 686 | 7.08 | 15 | good | 445 | 14.5 |
| Inventive Example 3 | 0.15 | 0.02 | 0.5 | 686 | 7.06 | 14 | good | 400 | 12.0 |
| Inventive Example 4 | 0.10 | 0.01 | 0.3 | 686 | 7.10 | 14 | good | 448 | 14.8 |
| Inventive Example 5 | 0.10 | 0.01 | 0.3 | 686 | 7.10 | 14 | good | 448 | 14.8 |
| Inventive Example 6 | 0.10 | 0.01 | 0.3 | 686 | 7.10 | 14 | good | 448 | 14.8 |
| Inventive Example 7 | 0.08 | 0.02 | 0.3 | 686 | 7.08 | 15 | good | 445 | 14.5 |
| Inventive Example 8 | 0.09 | 0.01 | 0.3 | 686 | 7.08 | 15 | good | 445 | 14.5 |
| Comparative Example 1 | 0.10 | 0.05 | 0.5 | 686 | 7.08 | 15 | poor | 445 | 14.5 |
| Comparative Example 2 | 0.10 | 0.08 | 1.5 | 686 | 7.08 | 15 | poor | 445 | 14.5 |
| Comparative Example 3 | 0.10 | 0.20 | 0.4 | 686 | 7.08 | 15 | poor | 380 | 11.0 |

*1: Free binder mass after magnetic separation/mass of iron-based mixed powder before magnetic separation Inventive Examples 1 to 8 according to the present invention all exhibited good filling variation. Inventive Examples 1 to 8 also had nearly the same, good values for the tensile strength and impact value of the sintered body as when not adding a flowability improving agent.

As a comparative example, the same combination as for Inventive Example 2 in Table 1 was heated and mixed under the same conditions as for Inventive Example 1 and then cooled to 80° C. and charged into a nauta mixer. At this time, dust was collected at the discharge port of the high-speed mixer, and carbon black was added and mixed. Next, under the same conditions as the above Inventive Examples, the filling performance of the iron-based powder and the tensile strength and impact value of the sintered body were evaluated. The evaluation results for Comparative Example 1 are shown in Table 2.

Furthermore, the same combination as for Inventive Example 2 in Table 1 was heated and mixed under the same conditions as for Inventive Example 1 and then cooled to 100° C. and charged into a nauta mixer. At this time, dust was collected at the discharge port of the high-speed mixer, and carbon black was added and mixed. Next, under the same conditions as Comparative Example 1, the filling performance of the iron-based powder and the tensile strength and impact value of the sintered body were evaluated. The evaluation results for Comparative Example 2 are shown in Table 2.

With stearamide and Ethylene Bis Stearamide as binders, the iron powder, Cu powder, and graphite powder listed for Inventive Example 1 in Table 1 were heated and mixed in a Henschel-type high-speed mixer, and after cooling to 60° C., carbon black was added directly and mixed. Next, under the same conditions as Comparative Example 1, the filling performance of the iron-based powder and the tensile strength and impact value of the sintered body were evaluated. The evaluation results for Comparative Example 3 are shown in Table 2.

As shown in Table 2, Comparative Example 1 had a poor appearance. Comparative Example 2 had a large filling variation and a poor appearance. Comparative Example 3 had a small filling variation yet a poor appearance. Furthermore, the sintered body strength was lower than for Comparative Example 1.

REFERENCE SIGNS LIST

1: Iron powder
2: Alloy component (graphite)
3: Alloy component (copper powder)
4: Binder
5: Cavity
6: Test iron powder
7: Filling shoe
8: Movement direction

The invention claimed is:

1. Iron-based powder for powder metallurgy, wherein either or both of an alloy component and a cutting ability improving agent are adhered to a surface of an iron powder for powder metallurgy by a binder with a melting point of 150° C. or lower, carbon black is adhered to a surface of the binder, and an amount of free binder is 0.02 mass % or less.

2. The iron-based powder for powder metallurgy of claim 1, wherein coverage of the surface of the iron powder by the binder is from 30% to 100% of a surface area of the iron powder.

3. The iron-based powder for powder metallurgy of claim 1, wherein the binder is one or a mixture selected from the group consisting of fatty acid, fatty acid amide, fatty acid bisamide, and metal soap.

4. The iron-based powder for powder metallurgy of claim 1, wherein coverage of a bonding surface of the binder by the carbon black is 30% or more of a bonding surface area of the binder.

5. The iron-based powder for powder metallurgy of claim 1, wherein a specific surface area of the carbon black is in a range of 50 $m^2/g$ to 100 $m^2/g$.

6. The iron-based powder for powder metallurgy of claim 1, wherein a specific surface area of the iron powder is in a range of 0.01 $m^2/g$ to 0.1 $m^2/g$.

7. The iron-based powder for powder metallurgy of claim 1, wherein a specific surface area of the iron-based powder for powder metallurgy is in a range of 0.05 $m^2/g$ to 0.5 $m^2/g$.

8. The iron-based powder for powder metallurgy of claim 2, wherein the binder is one or a mixture selected from the group consisting of fatty acid, fatty acid amide, fatty acid bisamide, and metal soap.

9. The iron-based powder for powder metallurgy of claim 8, wherein coverage of a bonding surface of the binder by the carbon black is 30% or more of a bonding surface area of the binder.

10. The iron-based powder for powder metallurgy of claim 9, wherein a specific surface area of the carbon black is in a range of 50 $m^2/g$ to 100 $m^2/g$.

11. The iron-based powder for powder metallurgy of claim 10, wherein a specific surface area of the iron powder is in a range of 0.01 $m^2/g$ to 0.1 $m^2/g$.

12. The iron-based powder for powder metallurgy of claim 11, wherein a specific surface area of the iron-based powder for powder metallurgy is in a range of 0.05 $m^2/g$ to 0.5 $m^2/g$.

13. The iron-based powder for powder metallurgy of claim 2, wherein coverage of a bonding surface of the binder by the carbon black is 30% or more of a bonding surface area of the binder.

14. The iron-based powder for powder metallurgy of claim 2, wherein a specific surface area of the carbon black is in a range of 50 $m^2/g$ to 100 $m^2/g$.

15. The iron-based powder for powder metallurgy of claim 2, wherein a specific surface area of the iron powder is in a range of 0.01 $m^2/g$ to 0.1 $m^2/g$.

16. The iron-based powder for powder metallurgy of claim 2, wherein a specific surface area of the iron-based powder for powder metallurgy is in a range of 0.05 $m^2/g$ to 0.5 $m^2/g$.

17. The iron-based powder for powder metallurgy of claim 3, wherein coverage of a bonding surface of the binder by the carbon black is 30% or more of a bonding surface area of the binder.

18. The iron-based powder for powder metallurgy of claim 3, wherein a specific surface area of the carbon black is in a range of 50 $m^2/g$ to 100 $m^2/g$.

19. The iron-based powder for powder metallurgy of claim 3, wherein a specific surface area of the iron powder is in a range of 0.01 $m^2/g$ to 0.1 $m^2/g$.

20. The iron-based powder for powder metallurgy of claim 3, wherein a specific surface area of the iron-based powder for powder metallurgy is in a range of 0.05 $m^2/g$ to 0.5 $m^2/g$.

* * * * *